US006976640B2

(12) United States Patent
Chen

(10) Patent No.: US 6,976,640 B2
(45) Date of Patent: Dec. 20, 2005

(54) AIR GUN WITH A QUICK-RELEASING DEVICE

(76) Inventor: Kuo-Liang Chen, No. 246-1, Changma Rd., Changhua (TW)

( * ) Notice: Subject to any disclaimer, the term of this patent is extended or adjusted under 35 U.S.C. 154(b) by 223 days.

(21) Appl. No.: 10/726,513

(22) Filed: Dec. 4, 2003

(65) Prior Publication Data

US 2005/0133637 A1 Jun. 23, 2005

(51) Int. Cl.[7] ..... B05B 1/28

(52) U.S. Cl. ..... 239/291; 239/290; 239/390; 239/391; 239/525; 239/530; 239/532; 239/583; 239/586; 239/600; 239/DIG. 21; 285/316; 285/317; 285/320; 403/322.4

(58) Field of Search ..... 239/290, 291, 239/525, 530, 532, 390, 391, 589, 583, 586, 239/600, 601, DIG. 21, DIG. 22; 285/305, 285/312, 316, 317, 319, 320; 403/314, 322.4, 403/DIG. 4

(56) References Cited

U.S. PATENT DOCUMENTS 2,604,361 A * 7/1952 Yates ..... 239/291
2,917,244 A * 12/1959 Gould ..... 239/291
3,774,847 A * 11/1973 Malec ..... 239/586
3,790,085 A * 2/1974 Ayer ..... 239/291
3,827,635 A * 8/1974 Krakowski et al. ..... 239/391
3,895,757 A * 7/1975 Di Loreto ..... 239/291
3,910,502 A * 10/1975 Mermillod ..... 239/531
4,919,334 A * 4/1990 Hartmann et al. ..... 239/600
5,020,726 A * 6/1991 Myres ..... 239/525
5,832,974 A * 11/1998 Jou ..... 239/600
6,142,387 A * 11/2000 Jou ..... 239/390
6,505,784 B1 * 1/2003 Jou ..... 239/525

* cited by examiner

*Primary Examiner*—Steven J. Ganey
(74) *Attorney, Agent, or Firm*—Fei-Fei Chao; Bingham McCutchen LLP

(57) ABSTRACT

An air gun with a quick-releasing device has a body, a head tube attached to the body and a detachably functional tip, wherein the quick-releasing device is attached to a distal end of the head tube to secure the detachably functional tip. The quick-releasing device has a slit defined in the distal end of the head tube to communicate with an inner space of the head tube, a locking sheet movably received inside the slit to partially enter the inner space of the head tube, and a locking lever pivotally mounted on the head tube to drive the locking sheet to move in a vertical direction. Thereby, the locking sheet is allowed to leave the inner space of the head tube when a user presses the locking lever to enable easy release of the attached functional tip and then to exchange the original tip for another functional tip.

9 Claims, 5 Drawing Sheets

AIR GUN WITH A QUICK-RELEASING DEVICE

BACKGROUND OF THE INVENTION

1. Field of the Invention

The invention relates to an air gun with a quick-releasing device, and particularly to an air gun with which functional tips can be changed easily and conveniently.

2. Description of Related Art

Air guns are sorted into two types according to their different functions. One is a dust-removing gun and the other is a gas-filling gun. With regard to the dust-removing gun, the dust-removing gun has a connector attached to the front of the gun to specifically connect with a gas tube. Therefore, the dust-removing gun has only one function of blowing dust away whereby a user has to spend more money and save space for this, and accordingly other single-use tools.

With regard to the gas-filling gun, it also has a connector with a specific configuration to connect with only inflating nozzles. Therefore, when a user who already owns a dust-removing gun wants to inflate tires, balloons, balls or inflatable boats, the user can not use the dust-removing gun but has to buy a gas-filling gun instead. Therefore, the user spends twice to buy two air guns for those individual purposes. Two air guns also take double the space in a storage room and may cause twice as much trouble in maintenance.

The present invention has arisen to provide an air gun with a quick-releasing device to eliminate or obviate the drawbacks of the conventional dust-removing gun and the conventional gas-filling gun.

SUMMARY OF THE INVENTION

A first objective of the present invention is to provide an air gun with a quick-releasing device with which functional tips can be quickly and conveniently changed to provide versatility to the air gun.

Further benefits and advantages of the present invention will become apparent after a careful reading of the detailed description in accordance with the drawings.

DETAILED DESCRIPTION OF THE PREFERRED EMBODIMENT

An air gun with a quick-releasing device in accordance with the present invention comprises a body, a head tube attached to the body, and a detachable tip. Wherein the head tube has a distal end and the quick-releasing device attached to the distal end.

Figure 1:
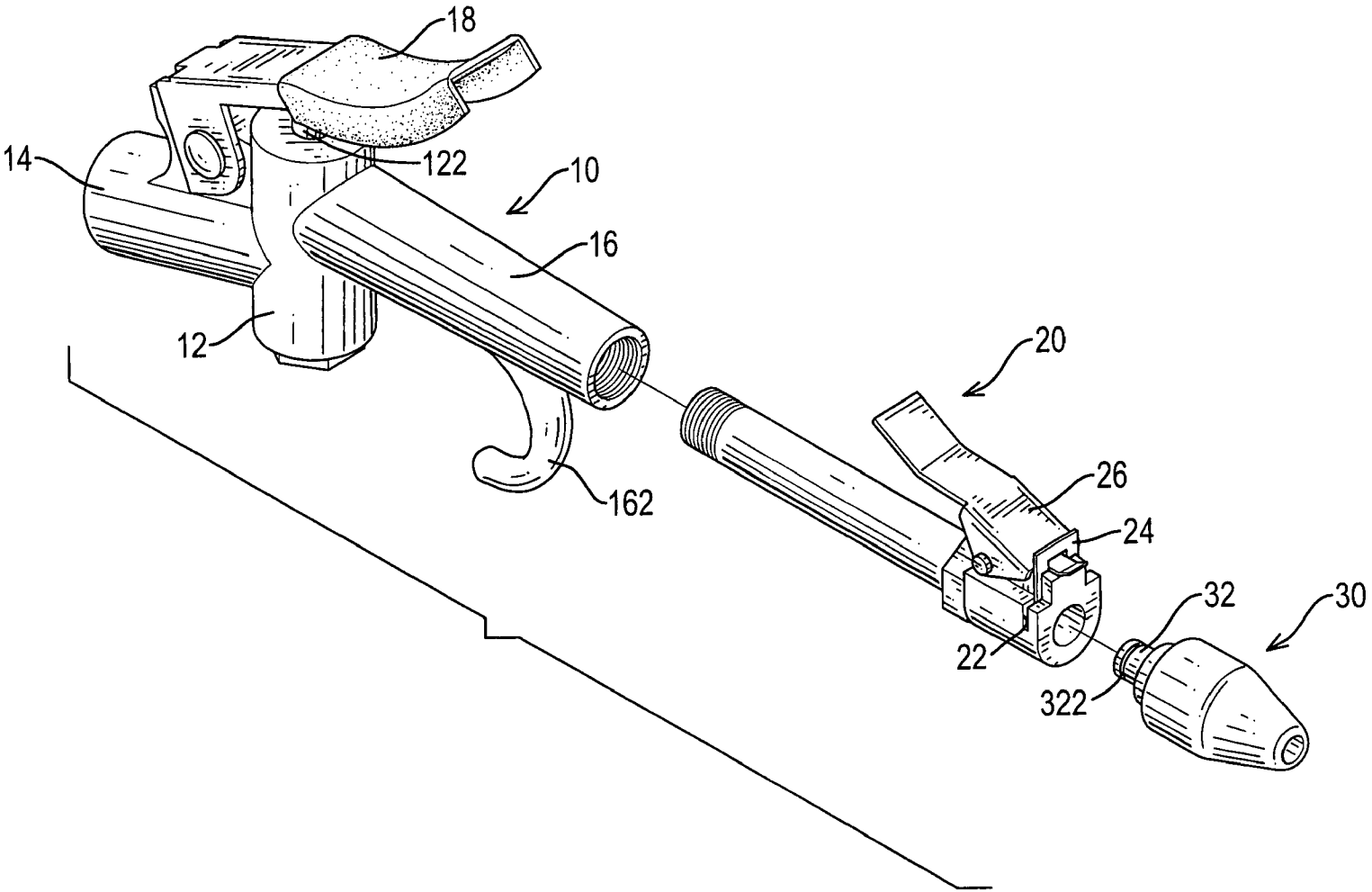
FIG. 1 is an exploded perspective view of an air gun with a quick-releasing device in accordance with the present invention.
Figure 2:
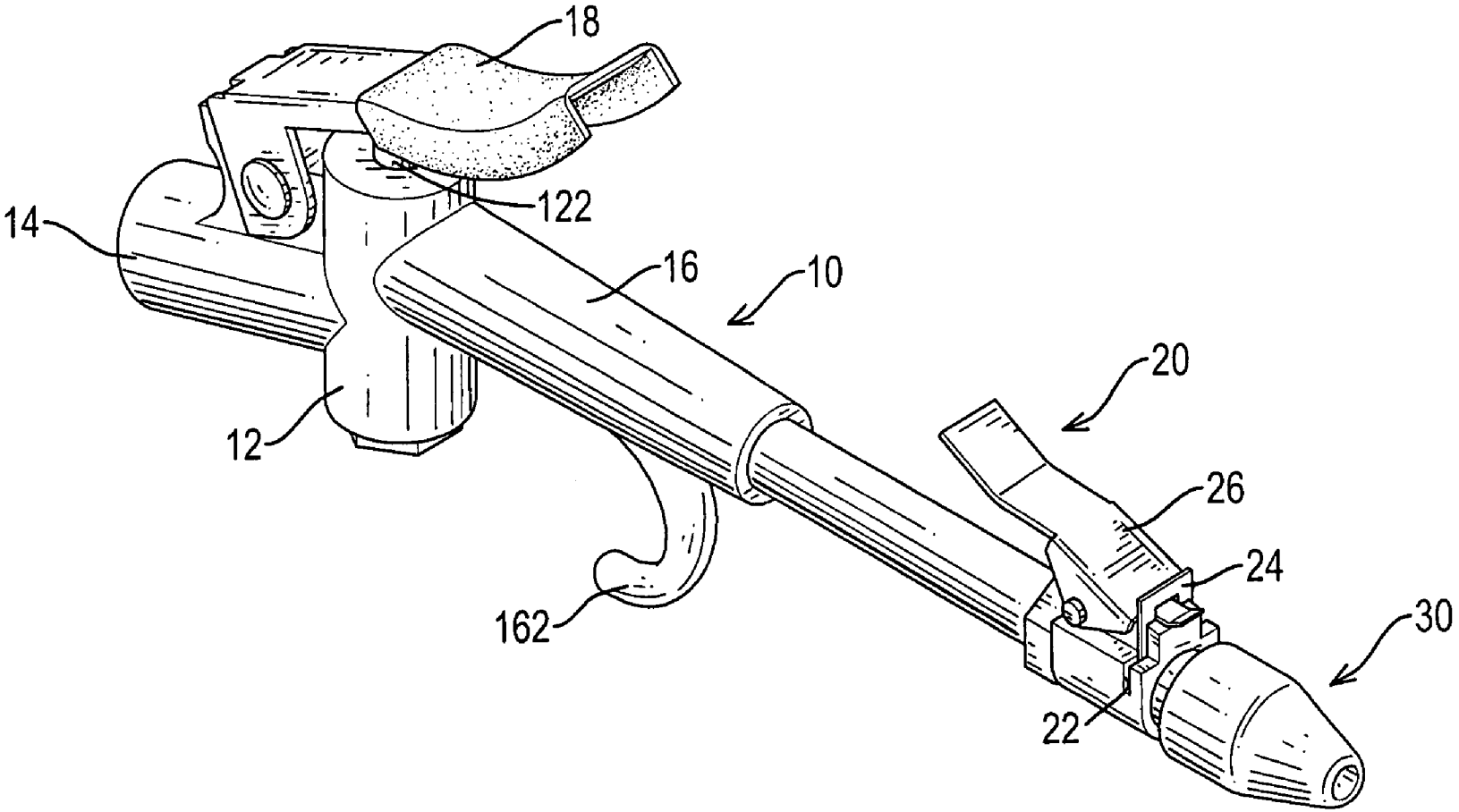
FIG. 2 is a perspective view of the air gun with the quick-releasing device in combination.

With reference to FIGS. 1 and 2, a preferred embodiment of the air gun in accordance with the present invention comprises a body (10) with a front end, a head tube (20) attached to the front end of the body (10), a quick-releasing device attached in front of the head tube (20), and a functional tip (30) attached to the head tube (20) by means of the quick-releasing device.

The body (10) is gun-shaped and has a valve column (12) with a controlling rod (122), a rear tube (14), a front tube (16), a valve lever (18), and an optional handle (162). The valve column (12) has a top face, a front end and a rear end. The controlling rod (122) is movably and axially received inside the valve column (12) to control gas flowing from the air gun. The rear tube (14) is attached to the rear end of the valve column (12) and adapted to communicate with a gas supply source (not shown). The front tube (16) is attached to the front end of the valve column (12) and has a threaded distal end and a bottom. The handle (162) is formed on the bottom on the front tube (16). The valve lever (18) is pivotally mounted on the rear tube (14) and extends toward to the front tube (16) to selectively press the controlling rod (122) to control the air gun.

The head tube (20) has a threaded abutting end (not numbered) and a distal end. The threaded abutting end is screwed with the threaded distal end of the front tube (16) on the body (10). The quick-releasing device (20) is constructed on the distal end of the head tube (20) and comprises a slit (22), a locking sheet (24) and a locking lever (26). The slit (22) is vertically defined in the distal end of the head tube (20) to communicate with an inner space (not numbered) of the head tube (20). The locking sheet (24) is movably received inside the slit (22) to partially enter the inner space of the head tube (20). The locking lever (26) is pivotally mounted on the head tube (20) and has a tongue (not numbered) penetrating the locking sheet (24) to drive the locking sheet (24) to move in a vertical direction. Thereby, the locking sheet (24) is allowed to leave the inner space of the head tube (20) when the locking lever (26) is actuated by a user. The locking lever (26) is controlled by a recoiling spring (not shown) attached under the locking lever (26) to automatically recover or keep the locking lever (26) at a standing locking position, i.e., the locking sheet (24) is pressed down to enter the inner space of the head tube (20).

The functional tip (30) has an insert (32) and an annular cutout (322) defined around the insert (32). The insert (32) has an outer diameter matched with an inner diameter of the head tube (20) to allow the insert (32) to enter the head tube (20). The annular cutout (322) aligns with the slit (22) so that the locking sheet (24) wedges into the annular cutout (322) to keep the functional tip (30) locked. As shown in FIG. 1, the functional tip (30) is a cone-shaped nozzle for blowing dust away. When changing the functional tip (30), the locking lever (26) is pressed to lift the locking sheet (24) to depart from the inner space of the head tube (20). Therefore, the insert (32) is enabled to be pulled out of the head tube (20) to be exchanged with another functional tip.

Figure 3:
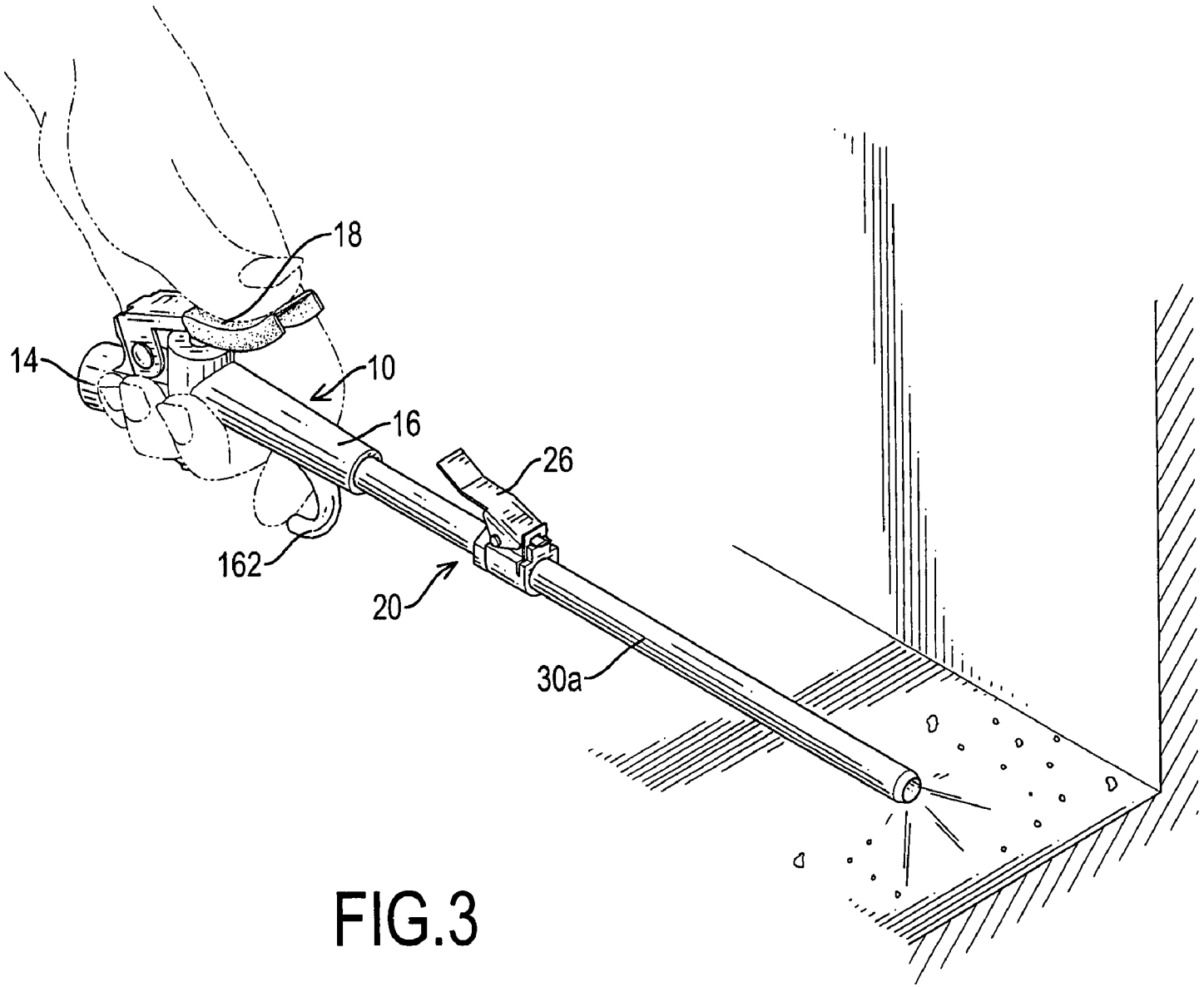
FIG. 3 is a first operational perspective view of the air gun with the quick-releasing device as shown in FIG. 2, wherein a dust-removing tube is attached to the quick-releasing device.

With reference to FIG. 3, when the air gun with a tube nozzle (30*a*) is operated to remove dust, the body (10) is held with one hand and the valve lever (18) is pressed down by the thumb to allow gas flowing through the body (10) from the gas supply source to environment via the tube nozzle (30*a*).

Figure 4:
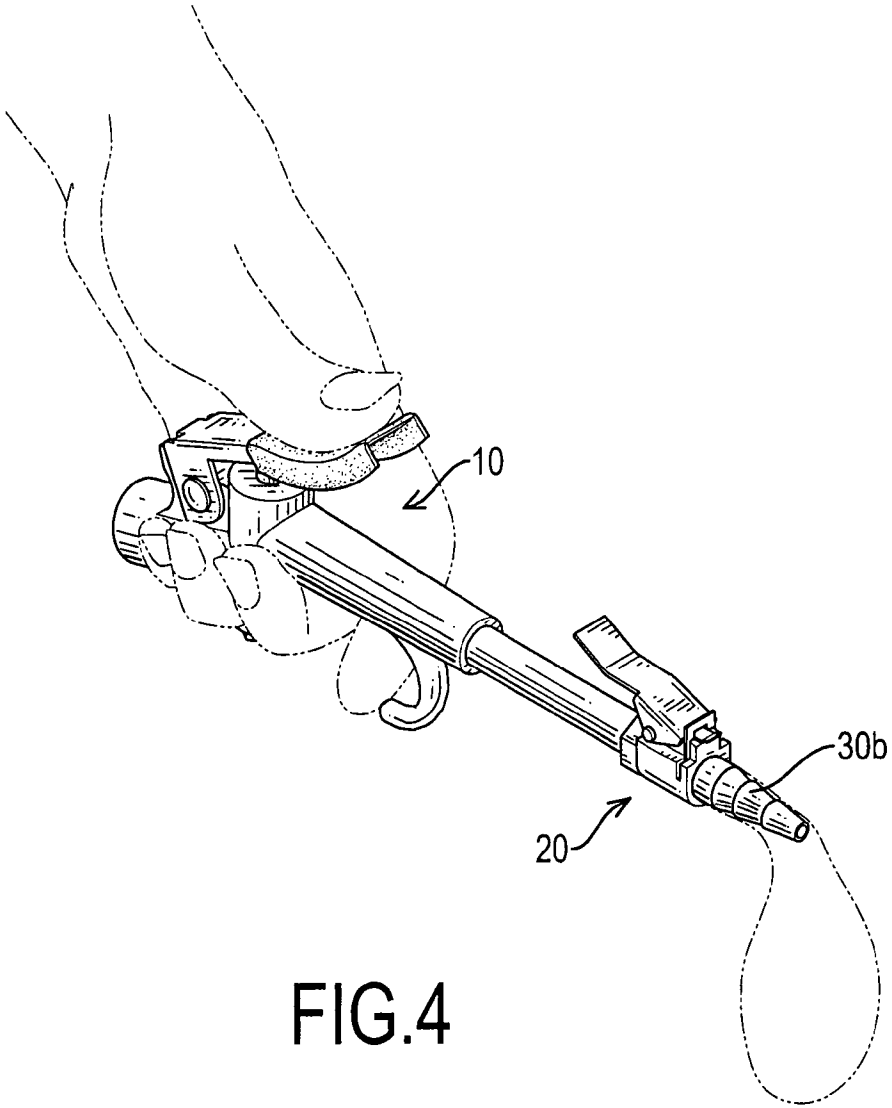
FIG. 4 is a second operational perspective view of the air gun with the quick-releasing device as shown in FIG. 2, wherein a ribbed nozzle with multiple ladder sections is attached to the quick-releasing device.
Figure 5:
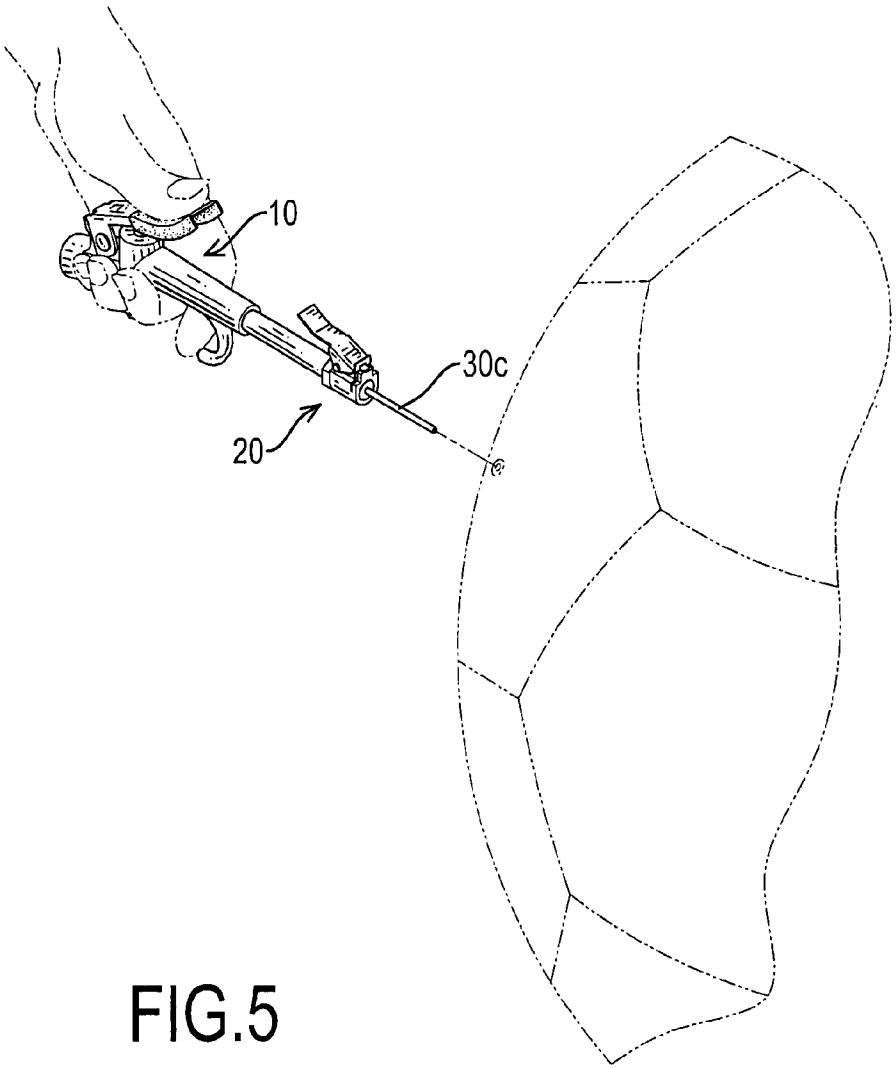
FIG. 5 is a third operational perspective view of the air gun with the quick-releasing device as shown in FIG. 2, wherein an inflating needle is attached to the quick-releasing device.

With reference to FIG. 4, the functional tip is a ribbed nozzle (30*b*) for inflating balloons. With reference to FIG. 5, the functional tip is a needle nozzle (30*c*) for inflating balls. Selectively, the air gun is enabled to combine with other functional tips for inflating inflatable boats or other equipment.

According to the above description, the air gun can be fitted quickly and conveniently with any one of multiple functional tips to increase versatile functions by means of the quick-releasing device.

Although the invention has been explained in relation to its preferred embodiment, many other possible modifications and variations can be made without departing from the spirit and scope of the invention as hereinafter claimed.

What is claimed is:

1. An air gun with a quick-releasing device comprising:

a body (10) adapted to control gas flowing through the air gun;

a head tube (20) attached to a front of the body (10) and having a distal end, and the quick-releasing device mounted on the distal end of the head tube (20), wherein the quick-releasing device comprises:

a slit (22) vertically defined in the distal end of the head tube (20) to communicate with an inner space of the head tube (20);

a locking sheet (24) movably received inside the slit (22) to partially enter the inner space of the head tube (20); and a locking lever (26) with a recoiling spring pivotally mounted on the head tube (20) and having a tongue penetrating the locking sheet (24), wherein the recoiling spring keeps the locking lever (26) pressing the locking sheet (24) down to enter the inner space of the head tube (20); and a detachably functional tip (30) attached to the head tube and secured by engaging with the locking sheet of the quick-releasing device.

2. The air gun as claimed in claim 1, wherein the body (10) comprises:

a valve column (12) having a top face, a front end and a rear end, and a controlling rod (122) movably received inside the valve column (12);

a rear tube (14) attached to the rear end of the valve column (12) and adapted to communicate with a gas supply source; and a front tube (16) attached to the front end of the valve column (12) and having a distal end to engage with the head tube (20).

3. The air gun as claimed in claim 1, wherein the front tube (16) of the body (10) has a bottom and a handle (162) attached to the bottom of the front tube (16).

4. The air gun as claimed in claim 2, wherein the front tube (16) of the body (10) engages with the head tube (20) by means of threads.

5. The air gun as claimed in claim 3, wherein the front tube (16) of the body (10) engages with the head tube (20) by means of threads.

6. The air gun as claimed in claim 1, wherein the functional tip is a cone-shaped nozzle for blowing dust away.

7. The air gun as claimed in claim 1, wherein the functional tip is a tube nozzle (30*a*) for blowing dust away.

8. The air gun as claimed in claim 1, wherein the functional tip is a ribbed nozzle (30*b*) for inflating balloons.

9. The air gun as claimed in claim 1, wherein the functional tip is a needle nozzle (30*c*) for inflating balls.

* * * * *